US008952803B2

(12) United States Patent
Blum et al.

(10) Patent No.: US 8,952,803 B2
(45) Date of Patent: Feb. 10, 2015

(54) SYSTEM AND METHOD FOR PROTECTING A SECURITY SYSTEM

(75) Inventors: William R. Blum, Huntington Station, NY (US); Raymond J. Jordan, Holtsville, NY (US); Catherine C. Sottile-Ramos, Blue Point, NY (US)

(73) Assignee: Honeywell International Inc., Morristown, NJ (US)

( * ) Notice: Subject to any disclaimer, the term of this patent is extended or adjusted under 35 U.S.C. 154(b) by 391 days.

(21) Appl. No.: 13/221,943

(22) Filed: Aug. 31, 2011

(65) Prior Publication Data

US 2013/0049949 A1 Feb. 28, 2013

(51) Int. Cl.

| | |
|---|---|
| ***G08B 29/00*** | (2006.01) |
| ***G08B 25/00*** | (2006.01) |
| ***G08B 25/14*** | (2006.01) |

(52) U.S. Cl.

CPC ..... *G08B 25/001* (2013.01); *G08B 25/14* (2013.01)

USPC ..... 340/506; 340/500; 340/507; 340/286.02; 340/635; 340/518; 73/1.01; 73/195

(58) Field of Classification Search

USPC ..... 340/506, 507, 500, 501, 286.02, 635, 340/518, 606; 73/1.01, 195; 374/1

See application file for complete search history.

(56) References Cited

U.S. PATENT DOCUMENTS

| | | | | |
|---|---|---|---|---|
| 4,481,503 | A * | 11/1984 | Lehman et al. | 340/518 |
| 7,170,998 | B2 * | 1/2007 | McLintock et al. | 380/277 |
| 7,403,109 | B2 * | 7/2008 | Martin | 340/516 |
| 2002/0099945 | A1 * | 7/2002 | McLintock et al. | 713/186 |
| 2008/0079561 | A1 * | 4/2008 | Trundle et al. | 340/506 |
| 2008/0191861 | A1 * | 8/2008 | Mason et al. | 340/506 |

* cited by examiner

*Primary Examiner* — Steven Lim
*Assistant Examiner* — Sisay Yacob
(74) *Attorney, Agent, or Firm* — Rachael Casey; Husch Blackwell LLP

(57) ABSTRACT

A regional security system includes a control panel which can receive one or more delay parameters, associated with a type of sensor or detector, or a portion of a region being monitored. The delay parameters can be stored in a programmable storage unit. When an alarm indicator has been received from one of the sensors or detectors, an alarm indicating message along with an associated, programmed and pre-stored delay can be forwarded to a central station. If the system is disarmed before the delay interval has terminated, a cancel message can be sent to the central station.

20 Claims, 3 Drawing Sheets

SYSTEM AND METHOD FOR PROTECTING A SECURITY SYSTEM

FIELD

The application pertains to regional security, or monitoring, systems. More particularly, the application pertains to such systems which include circuitry to provide a level of security for self-contained monitoring systems.

BACKGROUND

Regional monitoring or security systems can be used in residential buildings to provide alarm indicating signals either locally, or to a displaced central station. Known alarms usually include a control panel with at least one display unit and keypad for use in controlling the system. In known alarm systems there is a delay associated with Exit/Entry and Security Industry Association (SIA) required dialer delays. During this time alarms are held by the panel. If a burglar locates and destroys the panel before one of the above times expires the alarm will not be sent and the system defeated.

To solve the above problem the alarm is generated when the zone is violated. It is sent as a special "delayed reporting" alarm type and includes a fixed delay time for the zone that was violated. Known implementations use a fixed delay which is usually set to a worst case value.

The alarm is then sent via either Internet or wireless communicator to an alarm receiver or an alarm transport service. The alarm is held by either the alarm transport service or the alarm receiver for the duration of the delay specified in the message plus an additional guard time to account for network transport times. Once this time runs out it is considered a real alarm.

If sent via the alarm transport service the alarm is forwarded to the central station. If sent to the receiver, the receiver releases the alarm to an automation system. If the system is disarmed before the delay has expired a cancel message is sent to either the alarm transport service or the receiver which will cancel the delivery of the delayed alarm.

DETAILED DESCRIPTION

Figure 1:
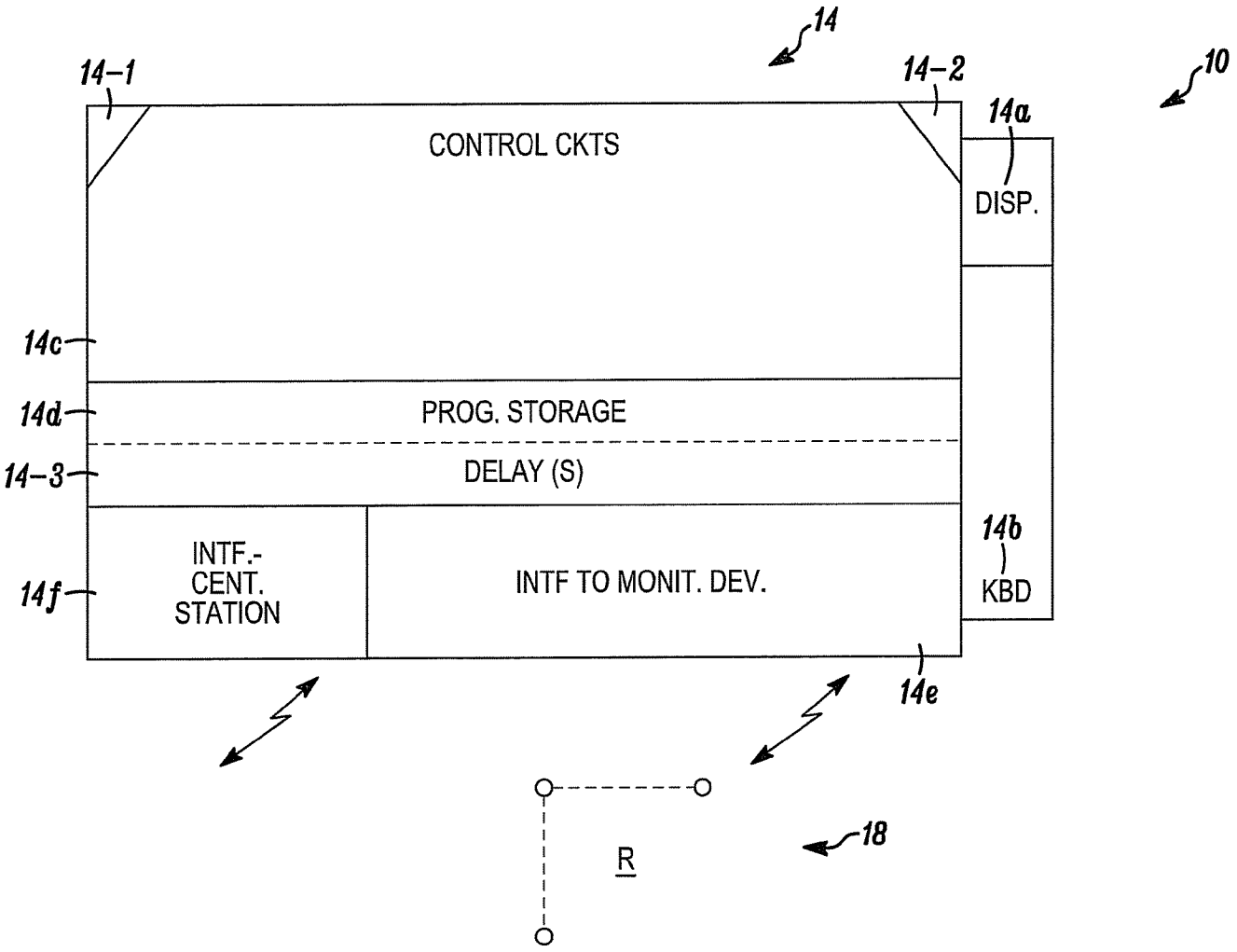
FIG. 1 is a block diagram of portions of an embodiment hereof.

While disclosed embodiments can take many different forms, specific embodiments hereof are shown in the drawings and will be described herein in detail with the understanding that the present disclosure is to be considered as an exemplification of the principles hereof, as well as the best mode of practicing same, and is not intended to limit the claims hereof to the specific embodiment illustrated.

In a disclosed embodiment, the delay is variable and can be based on how the panel was programmed. By making the delay variable security and response time can be improved on a custom basis from installation to installation. In yet another aspect, different delays could be set for different types of sensors or detectors. Alternately, different delays could be associated with different rooms or parts of a region being monitored.

FIG. 1 illustrates aspects of a system 10, in accordance herewith, that monitors on-going conditions in a region R. System 10 includes a control panel 14, located in the region R, and readily accessible therein. Panel 14 is coupled, wired or wirelessly, or both to a plurality of detectors or sensors 18 in the region R. Members of the plurality 18 can include glass break detectors, motion detectors, door detectors, smoke or fire detectors, thermal detectors, or gas detectors, all without limitation.

Panel 14 can carry a local display 14*a*, a keypad 14*b*, control circuits 14*c* coupled to the display 14*a* and keypad 14*b*. The control circuits 14*c* can be implemented, at least in part, by one or more programmable processors 14-1 and associated, executable control programs or software 14-2. The programs or software 14-2 can be stored in various types of memory units such as read-only, programmable read-only or read-write memory units.

Programmable storage 14*d* can also be coupled to the control circuits 14*c*. The programmable storage 14*d* can include storage for delay intervals 14-3 wherein one or more delay intervals can be stored. Such intervals can be entered locally via the keypad 14*b*, or via an interface 14*e* which couples the panel 14 to members of the plurality 18, or a wired or wireless interface 14*f* through which the panel 14 can communicate with displaced elements, including a central station, discussed subsequently.

Figure 2:
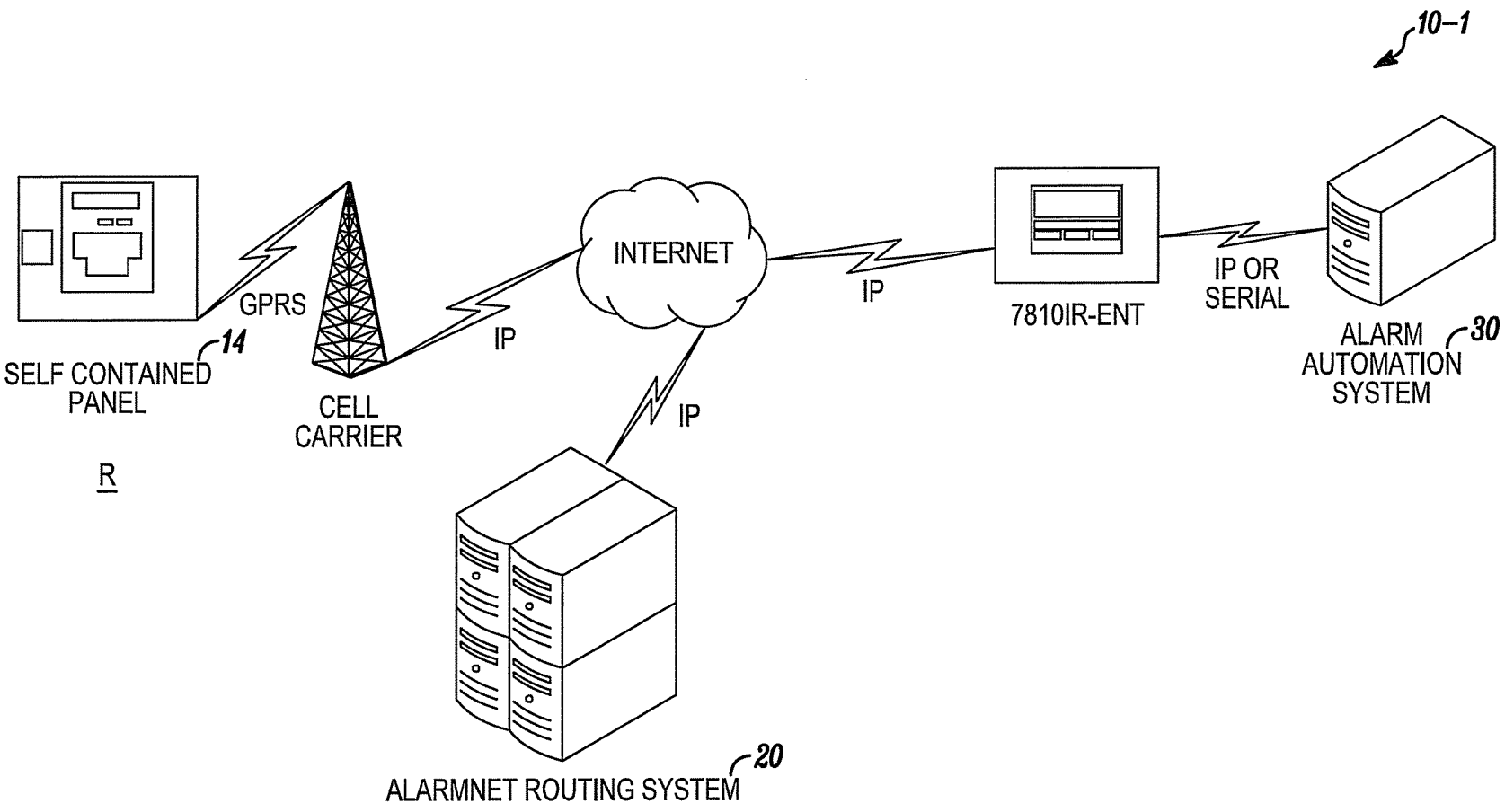
FIG. 2 is a block diagram with additional details as to an embodiment hereof.

FIG. 2 illustrates panel 14, monitoring region R as discussed above relative to FIG. 1, in the context of a communications system 10-1 which couples the panel 14 to a routing system 20 which communicates with a central station 30. Those of skill will understand that a variety of communications implementations come within the scope and spirit hereof. Those details are not limitations of the present exemplary embodiments.

Operationally, when the panel 14 is armed, and indicates that a zone is exhibiting a pre-alarm, an alarm or an intrusion, of a delayed reporting type, for example, an exit/entry or a dialer delay, panel 14 can transmit an appropriate message to routing system 20 and/or central station 30. This message can include information as to the triggering condition along with an associated delay setting for that particular alarm and an incremental margin value, along with an indication that this is a delayed alarm. Time of alarm as well as type of delay could also be transmitted.

This message then traverses the network and is received at the routing system 20 where it is placed in a wait state with the delay duration. An acknowledgement message or symbol can be returned to the panel 14.

A retry timer can be set to the delay setting without the margin value. If prior to the timeout of the retry timer, the system 20 and the panel 14 are still in communication, and the panel 14 is disarmed, a cancellation message will be sent from the panel indicating that it is an alarm cancel request. At that time, the system 20 can cancel delivery of the delayed alarm.

However, if the panel 14 has been destroyed, or the message represents a real alarm, no further traffic will be received from the panel 14 and the routing system 20 forwards notice of an alarm to the central station 30. If a normal check in is not received from the panel 14, indicating it is still functional, a communication failure can be indicated for that installation.

Figure 3:
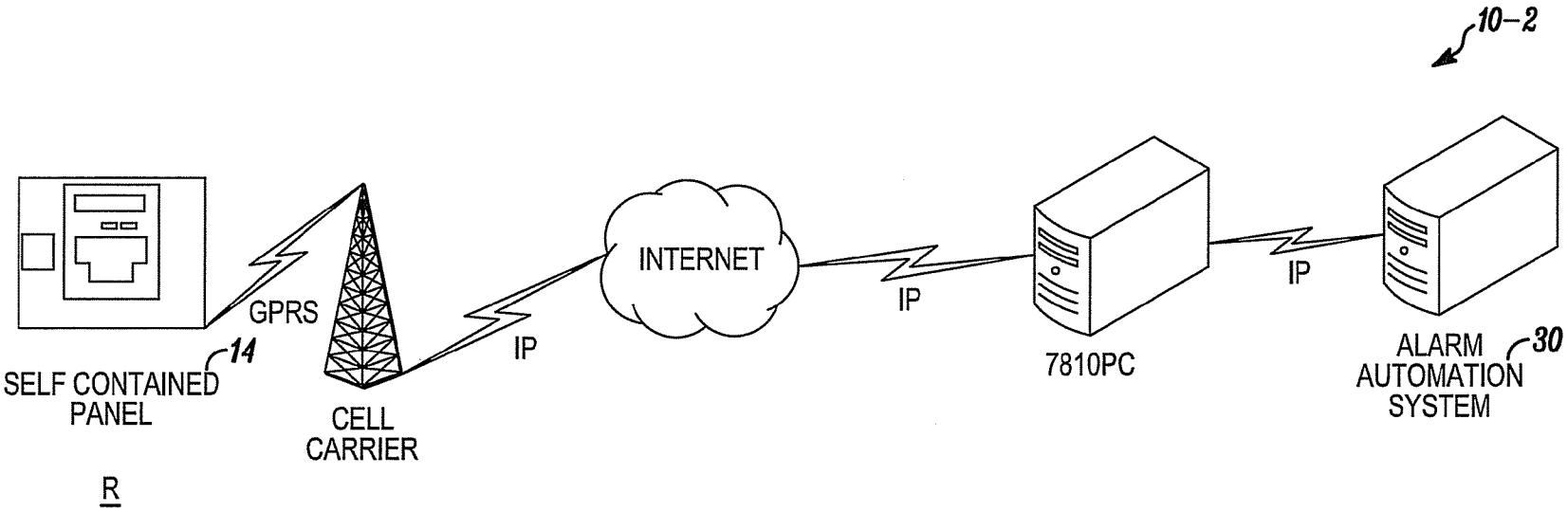
FIG. 3 is a block diagram with additional details of an alternate embodiment.

FIG. 3 illustrates a variation 10-2, of the system 10-1 of FIG. 2. As illustrated in FIG. 3, the panel 14 can communicate with the alarm automation system 30 via a variety of communications protocols and networks including cellular-type communications protocols and systems, or, internet protocols and computer based communications networks. In the presence of a delayed-type alarm condition, the panel 14 sends a message to the 7810PC.

The message can include information as to the cause of the alarm condition, and a delay interval setting for that particular alarm along with a margin interval and an acknowledge code indicating a delayed alarm. The message can be stored at the 7810PC for the duration of the interval. An acknowledge code can be returned to the panel 14. A retry timer at the 7810PC can be set to the delay interval received from the panel 14.

In the event of a normal disarm, if prior to the time out of the retry timer, the 7810PC is still communicating with the panel 14 and the panel 14 becomes disarmed, the delayed alarm message can be resent from the panel 14 along with an alarm cancel code. Receipt of this message at the 7810PC will result in the delayed alarm indicator message being deleted at the 7810PC. The system will continue on in an unalarmed state.

If the panel 14 is destroyed, or not disarmed, it is possible that no further communications will be received from the panel 14. In this instance, the 7810PC will forward the alarm message to the alarm automation system 30, and central monitoring station. Alternately, if the panel 14 has not been destroyed or damaged, it can send an all-is-well message along with an indicator that a normal test alarm message had previously been forwarded.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A regional monitoring system comprising:

control circuits of a security system coupled to a plurality of regional monitoring sensors and detectors of the security system, the control circuits include variable delay circuitry and a respective pre-set delay interval for each of the plurality of regional monitoring sensors and detectors; and a communications interface of the security system coupled to the control circuits wherein the control circuits respond to an alarm indicator from a member of the plurality by transmitting an alarm indicating message via the interface to a central monitoring station, the message specifies the respective, pre-set delay interval established by the variable delay circuitry for the member included as a value within the transmitted alarm message.

2. The system in claim 1 where the variable delay circuitry includes programmable storage.

3. The system as in claim 1 where the variable delay circuitry can establish at least one of different delays for different members of the plurality, or different portions of a region being monitored.

4. The system as in claim 2 where the programmable storage comprises circuits, responsive to at least one of, one manually entered delay, or a wirelessly received delay, to store an indicator of that delay in the programmable storage.

5. The system as in claim 4 where the control circuits, responsive to a system disarm indicator, transmit a cancel message via the interface.

6. The system as in claim 5 where the interface provides at least one of wired or, wireless communications.

7. The system as in claim 3 where the variable delay circuitry includes programmable storage.

8. The system as in claim 7 where the programmable storage comprises circuits, responsive to a plurality of manually entered delays, to store indicators of the entered delays in the programmable storage.

9. The system as in claim 8 which includes circuits to locally display at least one, alterable, pre-set delay interval.

10. The system as in claim 6 where members of the plurality include one or more of glass break detectors, door sensors, motion sensors, fire detectors, or gas detectors, and where the programmable storage includes locations for storage of delays associated with respective members of the plurality.

11. The system as in claim 1 where the variable delay circuitry includes programmable storage, and, where members of the plurality include one or more of glass break detectors, door sensors, motion sensors, fire detectors, or gas detectors, and where the programmable storage includes locations for storage of delays associated with respective members of the plurality.

12. A monitoring system which can be coupled to a plurality of sensors or detectors, the system comprising:

a control panel of a security system which includes a display device, a manually operable input unit and control circuits, the control circuits include variable delay circuitry; and a communications interface of the security system coupled to the control circuits wherein the control circuits respond to a selected indicator from a member of the plurality by transmitting an alarm indicating message via the interface to a central monitoring station, the message specifies a respective, pre-set delay interval established by the variable delay circuitry for the member, and a respective at least one programmable delay parameter for each of the plurality of sensors or detectors stored in a programmable storage unit of the variable delay circuitry, the respective at least one programmable delay parameter of the member is incorporated into the transmitted alarm indicating message.

13. The system as in claim 12 wherein, when an alarm indicator has been received from one of the sensors or detectors, an alarm indicating message along with an associated, programmed and pre-stored delay parameter can be forwarded to a displaced location via the communications interface.

14. The system as in claim 12 wherein the control circuits, responsive to detecting that the panel has been disarmed before the delay interval has terminated, transmit a cancel message, via the interface to the displaced location.

15. A method comprising:

establishing by, at least one of, downloading or manually entering a respective programmable delay interval into a local alarm monitoring panel for each of a plurality of sensors associated with the local alarm monitoring panel;

storing each of the respective intervals at a selected electronic location of the panel; and responding to a received alarm indicator from one to the plurality of sensors by forming a first message which includes at least an alarm type indicium and a representation of the stored respective delay interval of the one sensor, and transmitting the first message including a value of the representation of the stored delay interval to a central monitoring station at a displaced location.

16. The method as in claim 15 which includes receiving and analyzing the message, and, responsive to the analyzing, placing the alarm indicium into a wait state.

17. The method as in claim 16 which includes setting a retry delay.

18. The method as in claim 17 which includes responding to another received message, and determining if the message is an alarm cancel message.

19. The method as in claim 18 where, responsive to the determining, canceling the received and analyzed alarm indicium from the wait state.

20. The method as in claim 18 where, responsive to expiration of a retry delay, in the absence of an alarm cancel message, determining if an alarm should be initiated.

* * * * *